United States Patent [19]

Chaix et al.

[11] 4,072,189

[45] Feb. 7, 1978

[54] IMMERSION-TUBE HEAT EXCHANGER

[75] Inventors: Jean Edmond Chaix, Manosque; Maurice Fajeau, Pertuis; Edmond Le Borgne, Aix en Provence; Aimé Zerouki, Manosque, all of France

[73] Assignee: Commissariat a l'Energie Atomique, Paris, France

[21] Appl. No.: 675,251

[22] Filed: Apr. 9, 1976

[30] Foreign Application Priority Data

Apr. 18, 1975 France ..... 75 12213

[51] Int. Cl.[2] ..... F28D 7/12

[52] U.S. Cl. ..... 165/142; 165/155

[58] Field of Search ..... 165/142, 141, 154, 155; 138/114

[56] References Cited

U.S. PATENT DOCUMENTS

| | | | |
|---|---|---|---|
| 1,199,315 | 9/1916 | Sullivan | 165/142 |
| 1,689,927 | 10/1928 | Newhouse | 165/142 |
| 2,384,858 | 9/1945 | Thayer et al. | 165/142 |
| 2,870,997 | 1/1959 | Soderstrom | 165/142 |
| 3,097,630 | 7/1963 | Kinyon et al. | 122/34 |
| 3,330,336 | 7/1967 | Gobel | 165/142 |
| 3,868,994 | 3/1975 | Petrek | 165/142 |

FOREIGN PATENT DOCUMENTS

| | | | |
|---|---|---|---|
| 935,813 | 10/1973 | Canada | 165/142 |
| 993,111 | 10/1951 | France | 165/142 |

*Primary Examiner*—Charles J. Myhre
*Assistant Examiner*—Sheldon Richter
*Attorney, Agent, or Firm*—Cameron, Kerkam, Sutton, Stowell & Stowell

[57] ABSTRACT

In a tube-type heat exchanger which produces superheated steam directly while being of the once-through type, the tubes permit recycling of the vapor of the secondary fluid which is circulated within them. A coaxial sleeve mounted within the annular space between an intermediate tube and the pressure tube delimits an annular zone filled with heat-insulating stagnant vapor so as to isolate the vapor produced from the fluid in liquid phase.

7 Claims, 3 Drawing Figures

IMMERSION-TUBE HEAT EXCHANGER

This invention relates to a heat exchanger of the tube type for accomplishing heat transfer between two fluids circulated respectively inside and outside the tubes, one of said fluids designated as the primary fluid being intended to deliver heat to the other fluid designated as the secondary fluid which undergoes vaporization as it passes through the heat exchanger.

Heat exchangers of this type which are known at the present time can be considered to fall into two classes. In a first class, the heat exchangers are of the so-called "once-through" type. In other words, the flow of secondary fluid which is usually water and fed into each tube of an exchanger is wholly converted to a corresponding flow of saturated steam in a single pass within the tube. This saturated steam may first be passed into drying units and is then again fed into each tube of a second heat exchanger in order to be converted to superheated steam. In a second class of heat exchanger, superheated steam is produced directly from a supply of secondary fluid in the liquid state such as water, for example. However, the flow rate of superheated steam thus produced is lower than the flow rate of feed water since a fraction of this flow of water and possibly also a fraction of the flow of saturated steam are eliminated for the purpose of recycling.

The present invention is primarily directed to a tube-type heat exchanger of novel design which produces superheated steam directly while being of the once-through type, which represents a considerable technical improvement. This improvement is made possible by a novel concept of each tube of the heat exchanger, these tubes being so arranged as to carry out internal recycling directly as will be explained in detail hereinafter.

Moreover, the exchanger which is proposed offers the advantages arising from an assembly of simple design in which the secondary fluid can be supplied directly from a condenser without preliminary heating, does not present any differential expansion problems and makes it possible to obtain small temperature differences on a plate which is mounted within the heat exchanger and supports the exchanger tubes. Finally, the proposed design ensures easy disassembly of the different internal structures of the heat exchanger for either maintenance or inspection during operation.

To this end, the aforesaid heat exchanger of the immersion-tube type comprises an outer vessel fitted with a duct for supplying a primary fluid, a duct for the discharge of said primary fluid after circulation within the vessel, a partition plate for dividing the vessel into two regions consisting of a lower region at the pressure of the primary fluid and an upper region at the pressure of a secondary fluid which is vaporized by heat transfer with the primary fluid. Said partition plate is pierced by holes traversed by vertical immersion tubes which are carried by the plate and reserved for the circulation of the secondary fluid; said immersion tubes are each provided with a pressure tube which is open at the upper end for providing a communication with the region in which the vaporized secondary fluid is collected and closed at the lower end which penetrates into the primary fluid region. Each immersion tube in the heat exchanger is provided with an axial duct for supplying secondary fluid in liquid phase within the interior of the pressure tube. Said heat exchanger is characterized in that it comprises an intermediate tube which is coaxial with the admission duct and a screen mounted within the annular space delimited between the intermediate tube and the pressure tube. Said screen is constituted by a sleeve which is coaxial with the two tubes, the upper end of said sleeve being rigidly fixed to the intermediate tube and the lower end of said sleeve being open so as to delimit up to the full height of the sleeve with the intermediate tube an annular zone filled with stagnant vapor which forms a thermal insulation.

A noteworthy result achieved in particular by the presence of said annular zone which forms a thermal insulation is to prevent limitation of superheating which would otherwise occur as a result of heat transfer between the liquid phase employed for the low-temperature supply and the vapor phase which is being superheated.

In accordance with one particular embodiment of the invention, the intermediate tube extends into the pressure tube up to the vicinity of its closed lower end, the lateral surface of said intemediate tube being pierced with holes at a higher level than that of the lower end of the admission duct. Thus the secondary fluid phase which is still liquid and unvaporized and circulates in the upward direction in contact with the external wall of the intermediate tube can accordingly be freed from the vaporized phase and returned between the intermediate tube and the admission duct. This makes it possible on the one hand to heat the liquid phase of the secondary fluid within the admission duct and on the other hand to superheat the vaporized phase of the secondary fluid after withdrawal of the unvaporized liquid phase.

As an advantageous feature, the coaxial sleeve which forms a screen is provided in the vicinity of its lower end with a projecting annular flange which may be either continuous or non-continuous so as to center the sleeve by bearing on the external surface of the intermediate tube.

Moreover and according to requirements, the lower end of the sleeve delimits with the internal surface of the pressure tube an annular passage or alternatively has a flared shape in contact with said surface and is provided in that case with a series of holes through which the vaporized phase of the secondary fluid is permitted to pass.

In accordance with another feature of the heat exchanger under consideration, the region of the vessel at the pressure of the vaporized secondary fluid is provided with a heat-insulated admission manifold from which extend injector tubes, the end portion of each injector tube being adapted to penetrate into each admission duct with provision for a small clearance-space.

Preferably, each pressure tube extends vertically and rests on the partition plate which is mounted horizontally across the vessel by means of an annular bearing flange which is welded to the plate and on which are carried vertical fins for supporting the sleeve which penetrates into the interior of the pressure tube.

Moreover, and in order to facilitate the assembly of the elements of each immersion tube, each intermediate tube and each duct for the admission of the secondary fluid in liquid phase are provided at their upper ends with a flared portion having the shape of a conical funnel so that each duct can be centered in the corresponding intermediate tube on which it is freely applied, each assembly formed by an intermediate tube and by an admission duct being in turn rigidly fixed to the sleeve and centered within the interior of the pressure tube by means of the vertical fins.

Further characteristic features of an immersion-tube heat exchanger as constructed in accordance with the invention will become apparent from the following description of one exemplified embodiment which is given by way of indication and not in any limiting sense, reference being made to the accompanying drawings, wherein.

Figures 2, 2A:
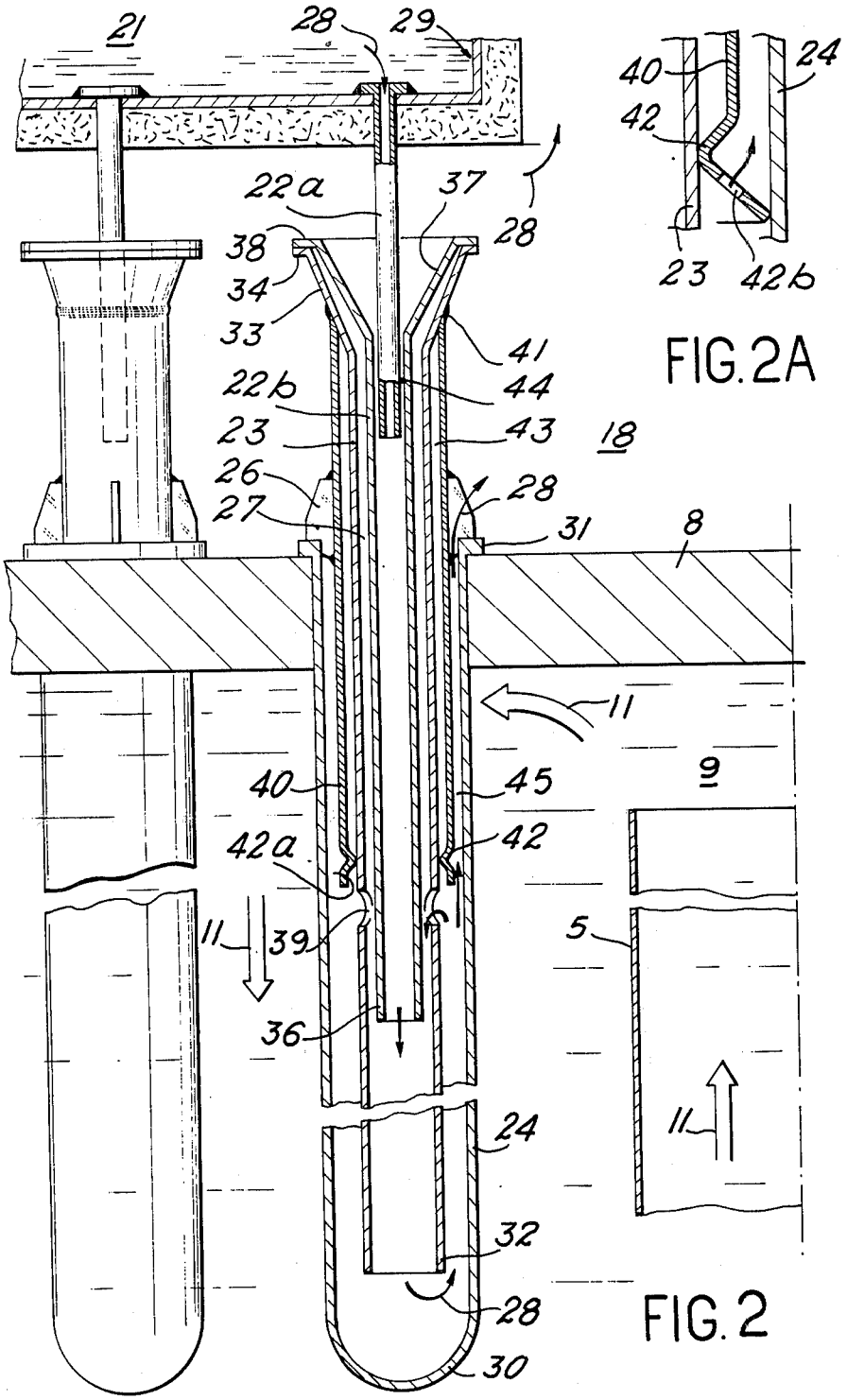
FIG. 2 is a view to a larger scale illustrating the construction of the immersion tubes of the heat exchanger.

FIG. 2*a* illustrates an alternative form of a detail of FIG. 2.

Figure 1:
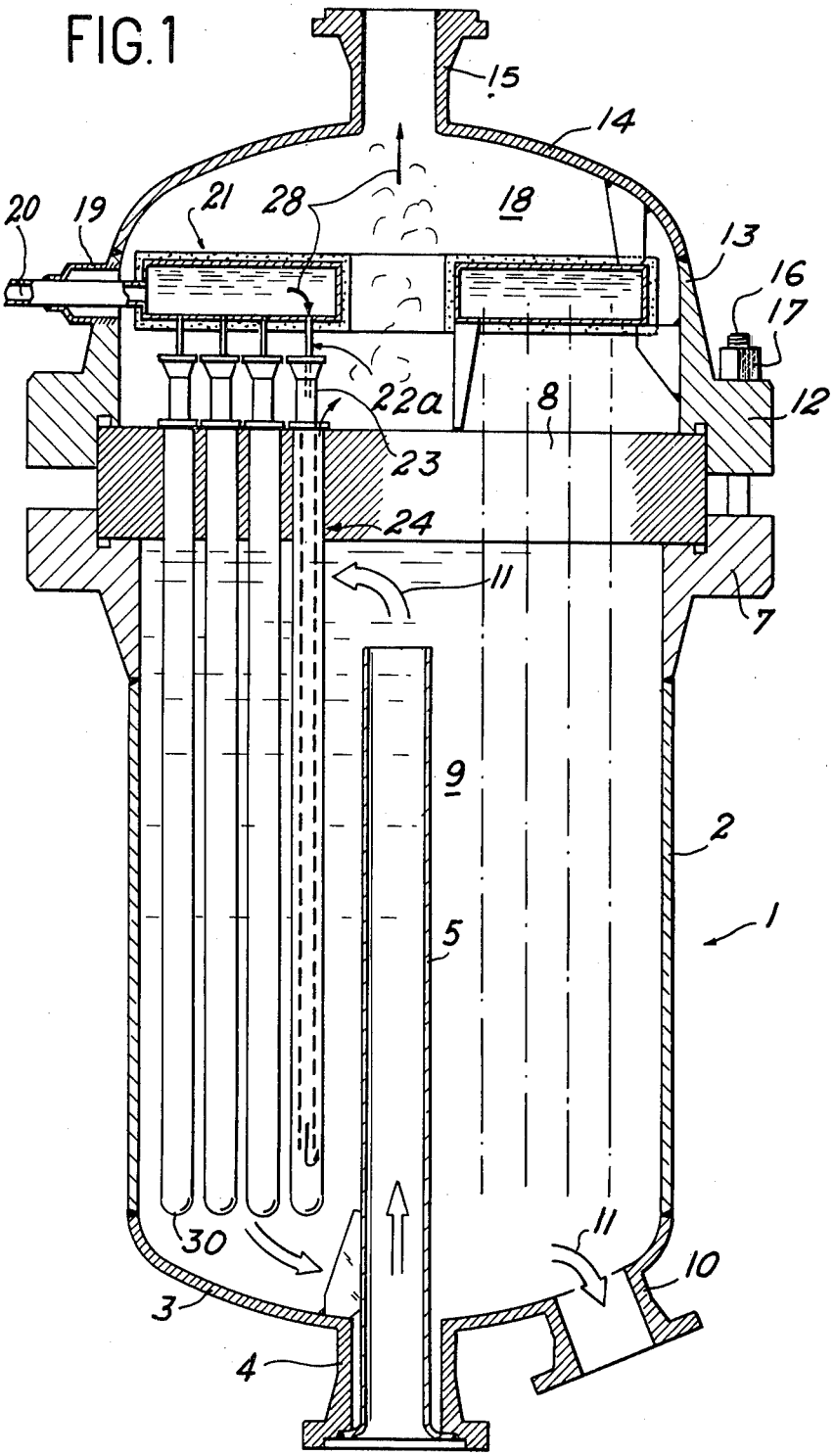
FIG. 1 is a diagrammatic longitudinal sectional view of a heat exchanger in accordance with the invention.

As shown in FIG. 1, the heat exchanger which is illustrated mainly comprises an outer vessel 1 constituted by a cylindrical shell 2 having a vertical axis and closed at the lower end by a hemispherical end-cover 3, there being formed in the axis of the shell a flanged nozzle 4 which provides admission to the interior of the vessel 1. There is passed through said nozzle 4 a chimney 5 for supplying the vessel with a primary fluid under pressure which is intended to transfer heat to a suitable secondary fluid. The outer shell 2 is also provided with a top horizontal annular shoulder 7 on which rests a partition plate 8. There is thus delimited between said plate 8, the shell, 2 and the end-cover 3 a region 9 in which the circulating primary fluid spreads out before being discharged from this latter via a flanged nozzle 10 provided in the end-cover 3 in a relatively displaced position with respect to the nozzle 4. The circulation of the primary fluid is shown diagrammatically by wide arrows 11 between the inlet and the outlet of the vessel 1.

The partition plate 8 is maintained against the annular shoulder 7 of the shell 2 by another annular shoulder 12 formed at the edge of a second cylindrical shell 13 which constitutes an extension of the shell 2 and is closed by a hemispherical end-cover 14 placed at the end opposite to the end-cover 3 with respect to the plate 8. The end-cover 14 is provided axially with a flanged nozzle 15 through which the vapor of the secondary fluid is intended to be discharged in a manner which will be explained hereinafter. The two shells 2 and 13 ensure continuity of the vessel 1 while being joined together by means of fixing studs 16 which cooperate with locking nuts 17. The shell 13 and its end-cover 14 thus delimit within the interior of the vessel 1 above the plate 8 a region 18 which is separated from the region 9 of the primary fluid. Heat transfer between these two fluids takes place by means of tubes in which the secondary fluid circulates and which extend beneath the plate 8 into the region 9, the invention being more especially concerned with the particular structure of these tubes.

The secondary fluid which usually consists of water is introduced into the region 18 in liquid phase through a lateral opening 19 of the shell 13 by means of an inlet pipe 20 which opens into a heat-insulated manifold 21 or water-box of generally annular shape which is connected to a series of injector tubes 22*a*. Said tubes in turn penetrate into admission ducts 22*b* with a small clearance, said ducts being placed within the interior of intermediate tubes 23 and these latter being in turn adapted to penetrate into vertical pressure tubes 24 which traverse the plate 8 and are supported on the top face of this latter by a top annular end-flange 31 (as shown in FIG. 2). The complete assembly formed by each association of a pressure tube 24, an intermediate tube 23 and an admission duct 22*b* constitutes an immersion tube of the heat exchanger. The vapor of the secondary fluid produced as this latter passes through the immersion tubes is collected in the zone 18 and discharged from this latter via the nozzle 15 provided in the top endcover 14 of the vessel. The circulation of the secondary fluid within the immersion tubes is represented diagrammatically by arrows 28 in the accompanying drawings.

FIG. 2 illustrates in greater detail the practical construction of the immersion tubes in accordance with the invention and the method adopted for mounting these latter on the partition plate of the heat-exchanger vessel. It is thus apparent that provision is made on the external surface of the manifold 21 for a layer 29 constituted by heat-insulating structure for isolating the secondary fluid in liquid phase as this latter is admitted into the manifold with respect to the same secondary fluid which is converted to superheated steam, passes out of the immersion tubes and is discharged from the heat exchanger through the nozzle 15. As also shown in this figure, each pressure tube 24 is closed at its lower end 30 which penetrates into the region 9 containing the primary fluid and is provided at the opposite end above the partition plate 8 with an annular bearing flange 31 which is welded to the plate in order to ensure leak-tight penetration of said tube through this latter.

The intermediate tube 23 is open at the lower extremity 32 in that portion which penetrates into the tube 24. Said extremity 32 is thus placed substantially in the vicinity of the tube-end 30 at a distance which permits upward flow of the secondary fluid within the external annular space, even in the event of formation of solid deposits within the tube 24. The corresponding injector tube 22*a* passes out of the manifold 21 and penetrates into the admission duct 22*b* with a small clearance-space 44. Said duct 22*b* is placed coaxially within the interior of the intermediate tube 23 by virtue of the shape of its upper extremity 37; this latter has a funnel profile which engages within a portion 33 of the tube 23 which also has the shape of a funnel but is flared at a slightly smaller angle. The two tubes 33 and 37 are applied against each other by means of annular shoulders 34 and 38 ; the assembly which is thus formed bears on the plate 8 and the annular flange 31 of the tube 24 by means of fins 26. The open lower extremity 36 of the duct 22*b* is located at a distance from the tube-end 30 which is greater than that of the extremity 32 of the intermediate tube. In the example under consideration, said intermediate tube 23 is provided in a region corresponding to the end of the vaporization zone and located above the lower extremity 36 of the admission duct 22*b* with a series of holes or slots 39 of suitable shape and profile for permitting recirculation of the secondary fluid in liquid phase within the intermediate annular duct 27 which is delimited by the duct 22*b* and the tube 23. In particular, said holes 39 can be distributed in a plurality of superposed rings on the tube 23 and have variable dimensions with respect to each other.

The secondary fluid in liquid phase which is supplied to the injector tubes 22*a* from the manifold 21 flows downwards within the duct 22*b* ; after having reached the lower end 30 of the pressure tube, said fluid then returns upwards within the annular space formed between the intermediate tube 23 and said pressure tube 24. Within said space, vaporization takes place on the hot wall constituted by the internal surface of the pressure tube 24 whilst the remaining liquid phase is collected on the cold wall constituted by the external surface of the intermediate tube 23. After passing through the holes 39 formed in the wall of the intermediate tube 23, the liquid phase is consequently returned to the immersion-tube supply between the extremity of the admission duct 22*b* and the intermediate tube 23 while heating of the secondary fluid in the liquid state is thus completed. In the meantime, the vapor alone continues to rise within the pressure tube 24 and is then collected in the region 18 after being superheated during the last portion of its path.

In order to improve the practical arrangements which are thus employed, each immersion tube is provided with a coaxial sleeve 40 which is mounted around the assembly constituted by the supply duct 22*b* and the intermediate tube 23. The top portion of said sleeve is rigidly fixed by means of a weld bead 41 for example to the funnel-shaped flared portion 33 of the intermediate tube 23 and is supported on the plate 8 and the annular flange 31 of the tube 24 by the vertical fins 26 which are welded to the external surface of the sleeve. As a result, the assembly formed by the duct 22*b*, the tube 23 and the sleeve 40 is centered within the interior of the pressure tube 24. Said sleeve 40 delimits with the external surface of the intermediate tube an annular space 43 surrounded by an external coaxial space 45 which is delimited between said sleeve and the internal surface of the pressure tube 24 through which the vapor flows and is discharged from the immersion tube after being superheated. The lower end of the sleeve 40 is provided with bosses disposed at intervals on its periphery or with a continuous projecting annular flange 42 which serves to center said sleeve by bearing on the external surface of the tube 23.

In the example considered in FIG. 2, the lower end of the sleeve 40 is open in order to delimit an annular passage 42*a* with the internal surface of the pressure tube 24 for the upward flow of the vaporized phase of the secondary fluid. In an alternative embodiment shown in FIG. 2*a*, the lower end of the sleeve 40 is flared so as to come into contact with the internal surface of the tube 24 but is provided in this case with a series of holes or baffles 42*b* through which the vapor is intended to pass.

The intermediate space 43 is filled with vapor which forms a layer of stagnant gas, said gas layer being intended to constitute a heat-insulating screen between the region of the annular space 45 in which the steam within the immersion tube undergoes superheating and the interior of the admission duct 22*b* through which the feedwater flows at an appreciably lower temperature. More efficient and faster superheating is accordingly achieved, both by reason of the foregoing and the fact that this superheating of the steam takes place within the annular space 45 which is narrower than the annular space located upstream between the tube 23 and the tube 24.

Part of the superheated steam condenses on the cold structures such as the heat-insulating structure 29 of the manifolds 21 or the injector tubes 22*a*. The condensate is collected within the funnel 37 and flows into the tube 22*b* via the annular space 44 formed between this latter and the tube 22*a*.

The operation of the immersion-tube heat exchanger as thus constructed may readily be deduced from the foregoing. The primary fluid which penetrates into the vessel 1 via the chimney 5 fills the region 9 beneath the partition plate 8 and circulates within said region between the immersion tubes before being discharged from the vessel via the nozzle 10. During its flow path, the hot primary fluid is in contact with the external surface of said immersion tubes whilst the secondary fluid circulates within these latter. Said secondary fluid is introduced in liquid phase from the modified 21 into each tube 22*a* and the associated duct 22*b*. The secondary fluid which is heated by the liquid phase as is this latter is recirculated within the intermediate annular space 27 then reaches the lower portion of the intermediate tube 23 then the end 30 of the pressure tube 24 and subsequently returns upwards within the space delimited within each immersion tube, between the tube 24 and the tube 23.

The greater part of the secondary fluid is vaporized. After having been collected by the coldest wall of the intermediate tube 23, the remaining liquid phase passes through the hole 39, then flows downwards into the bottom portion of the intermediate annular space 27 between the duct 22*b* and the tube 23 where it completes the process of heating the secondary supply fluid. The overall result achieved by this removal of the liquid phase is that only superheated steam wholly freed from the liquid phase is collected at the outlet of the immersion tube within the space 18, said superheated steam being finally discharged through the nozzle 15. It should be noted that, in the top portion of the intermediate annular space 27, there is always present a two-phase liquid-vapor mixture which serves as heat insulation between the cold secondary supply fluid and the vapor which is being superheated. Moreover, the presence of a second stagnant-vapor screen within the space 43 formed between said intermediate tube 23 and the auxiliary sleeve 40 which is mounted around this latter achieves a considerable improvement in the efficiency of superheating at the outlet of the immersion tube.

The heat exchanger as thus constructed is of very simple design and its advantages arise directly from the structure and operation of the immersion tubes. While producing an effect of total separation between the primary fluid and the secondary fluid, said immersion tubes avoid the use of conventional devices of the liquid-vapor separator type by virtue of the recirculation produced within the intermediate annular duct and of the heat insulation between the liquid supply phase and the superheated vapor phase at the outlet whilst the secondary fluid discharged from the heat exchanger is solely in superheated vapor phase while avoiding the need to recycle a fraction of the secondary fluid. Moreover, the design of the intermediate tubes, of the axial ducts for supplying secondary fluid to the immersion tubes and of the insulating sleeves is such as to permit of ready assembly and disassembly of the different elements employed with a view to carrying out maintenance and repairs during operation.

The use of suspended tubes also makes it possible to prevent the effects of differential expansion stresses since the mode of assembly of the immersion tubes permits free expansion of these latter in the region which contains the primary fluid without introducing stresses at the level of the connection between said tubes and the partition plate. The heat-exchanger design only makes it necessary to ensure that the pressure of the vapor of the secondary fluid within the immersion tubes is higher than the pressure of the liquid phase in order to prevent this latter as it is supplied to the tubes from mixing directly with the vapor through the space formed between the injector tube and the admission duct.

It is readily apparent that the invention is not limited to the example of construction which has been more especially contemplated in the foregoing but extends on the contrary to all alternative forms.

What we claim is:

1. A heat exchanger of the immersion-tube type comprising an outer vessel fitted with a duct for the supply of a primary fluid, a duct for the discharge of said primary fluid after circulation within the vessel, a partition plate for dividing the interior of the vessel into two regions consisting of a lower region at the pressure of the primary fluid and an upper region at the pressure of a secondary fluid to be vaporized by heat transfer with the primary fluid, said partition plate being pierced by holes for the insertion of vertical immersion tubes carried by the plate and reserved for the circulation of the secondary fluid, said immersion tubes being each provided with a pressure tube which is open at the upper end of providing a communication with the region in which the vaporized secondary fluid is collected and closed at the lower end which penetrates into the primary fluid region, in which each immersion tube is provided with an axial duct for supplying secondary fluid in liquid phase within the interior of the pressure tube, wherein said heat exchanger comprises an intermediate tube which is coaxial with the admission duct and a screen mounted within the annular space delimited between the intermediate tube and the pressure tube, said screen being constituted by a sleeve which is coaxial with the two tubes, the upper end of said sleeve being rigidly fixed to the intermediate tube and the lower end of said sleeve being open so as to delimit up to the full height of the sleeve with the intermediate tube an annular zone filled with stagnant vapor which forms a thermal insulation, said coaxial sleeve which forms a screen having in the vicinity of its lower end a projecting annular flange centering said sleeve by bearing on the external surface of the intermediate tube.

2. A heat exchanger of the immersion tube type according to claim 1, wherein the intermediate tube extends into the pressure tube up to the vicinity of its closed lower end, the lateral surface of said intermediate tube being pierced with holes at a higher level than that of the lower end of the admission duct so that the secondary fluid phase which is still liquid and unvaporized and circulates in the upward direction in contact with the external wall of the intermediate tube can accordingly be freed from the vaporized phase and returned between the intermediate tube and the admission duct so as to permit on the one hand heating of the liquid phase of the secondary fluid within the admission duct and on the other hand superheating of the vaporized phase of the secondary fluid after withdrawal of the unvaporized liquid phase.

3. A heat exchanger of the immersion-tube type according to claim 1, wherein the lower end of the coaxial sleeve delimits with the internal surface of the pressure tube an annular passage for the vaporized phase of the secondary fluid.

4. A heat exchanger of the immersion-tube type according to claim 1, wherein the lower end of the coaxial sleeve is flared so as to come into contact with the internal surface of the pressure tube and is provided with a series of holes through which the vaporized phase of the secondary fluid is permitted to pass.

5. A heat exchanger of the immersion-tube type according to claim 1, wherein the region of the vessel at the pressure of the vaporized secondary fluid is provided with a heat-insulated admission manifold from which extend injector tubes, the end portion of each injector tube being adapted to penetrate into each admission duct with provision for a small clearance-space.

6. A heat exchanger of the immersion-tube type according to claim 1, wherein each pressure tube rests on the partition plate which is mounted horizontally across the vessel by means of an annular bearing flange which is welded to the plate and wherein each intermediate tube and each duct for the admission of the secondary fluid in liquid phase are provided at their upper ends with a flared portion having the shape of a conical funnel so that each duct can be centered in the corresponding intermediate tube on which it is freely applied.

7. A heat exchanger of the immersion-tube type according to claim 6, including vertical fins which rest on the annular flange and on the plate serve to support the sleeve which penetrates into the pressure tube, said sleeve being welded to the external wall of the intermediate tube in such a manner that the assembly formed by the sleeve, the intermediate tube and the admission duct is centered within the pressure tube by means of said vertical fins.

* * * * *